US007325910B2

(12) United States Patent
Pelletier

(10) Patent No.: US 7,325,910 B2
(45) Date of Patent: Feb. 5, 2008

(54) SUBLIMATION PEN FOR USE IN A DYE SUBLIMATION PRINTING SYSTEM, AND METHOD OF USE OF THE DYE SUBLIMATION PRINTING SYSTEM

(76) Inventor: Andrée Pelletier, 2463 Centre Street, Montréal, Québec (CA) H3K 1J9

( * ) Notice: Subject to any disclaimer, the term of this patent is extended or adjusted under 35 U.S.C. 154(b) by 317 days.

(21) Appl. No.: 11/213,692

(22) Filed: Aug. 30, 2005

(65) Prior Publication Data

US 2007/0046740 A1 Mar. 1, 2007

(51) Int. Cl.
*B41J 2/175* (2006.01)
*B41J 2/215* (2006.01)

(52) U.S. Cl. ..... 347/85; 347/83

(58) Field of Classification Search ..... 347/85, 347/83, 102, 105

See application file for complete search history.

(56) References Cited

U.S. PATENT DOCUMENTS

| | | | | |
|---|---|---|---|---|
| 4,019,188 | A * | 4/1977 | Hochberg et al. | 347/83 |
| 4,376,945 | A | 3/1983 | Hara et al. | |
| 4,882,595 | A | 11/1989 | Trueba et al. | |
| 5,032,850 | A | 7/1991 | Andeen et al. | |
| 5,797,329 | A | 8/1998 | Okada | |
| 5,853,470 | A | 12/1998 | Martin et al. | |
| 5,910,810 | A | 6/1999 | Brooks et al. | |
| 6,019,457 | A | 2/2000 | Silverbrook | |
| 6,663,226 | B2 | 12/2003 | Min et al. | |
| 6,682,187 | B2 | 1/2004 | Yoshizawa et al. | |
| 6,698,879 | B1 * | 3/2004 | Hindriks et al. | 347/105 |
| 2005/0174412 | A1 * | 8/2005 | Codos et al. | 347/102 |

FOREIGN PATENT DOCUMENTS

| | | |
|---|---|---|
| DE | 3218142 | 11/1983 |
| EP | 1422063 | 5/2004 |
| WO | WO2005106109 A1 * | 11/2005 |

* cited by examiner

*Primary Examiner*—Hai Pham
*Assistant Examiner*—Carlos A. Martinez, Jr.
(74) *Attorney, Agent, or Firm*—Equinox Protection; Franz Bonsang

(57) ABSTRACT

A sublimation pen or cartridge for use in a dye sublimation printing system, which is to be used with sublimation inks of the type including at least a liquid carrier and solid-form pigments insoluble in the liquid carrier. The sublimation pen includes a pen main body, an ink inlet provided on the pen main body, and a variable-width ink passageway defined within the pen main body and capable of fluidly communicating with the ink inlet. The ink passageway defines a sublimation chamber vestibule adjacent to the ink inlet and capable of fluidly communicating therewith, and a sublimation chamber in fluid communication with the sublimation chamber vestibule, the sublimation chamber being wider than the sublimation chamber vestibule. The sublimation pen further includes a heating device means capable of transmitting heat to the sublimation chamber; and a nozzle mounted to the pen main body, the nozzle defining a narrow discharge channel opening at a first end into the sublimation chamber outlet, and opening at a second end outwardly of the sublimation pen. Sublimation ink injected in the pen body through the pen sublimation ink inlet may flow in the ink passageway, first through the sublimation chamber vestibule and then into the wider sublimation chamber within which the solid-state pigments of the sublimation ink are sublimed, the sublimed pigments being thereafter forcibly discharged out of the pen through the discharge channel of the nozzle.

11 Claims, 4 Drawing Sheets

SUBLIMATION PEN FOR USE IN A DYE SUBLIMATION PRINTING SYSTEM, AND METHOD OF USE OF THE DYE SUBLIMATION PRINTING SYSTEM

FIELD OF THE INVENTION

The present invention relates to printing systems and methods, and more particularly to dye sublimation printing system and method.

BACKGROUND OF THE INVENTION

Dye sublimation is a known process for printing images on mediums such as fabrics, paper, etc. This process involves "heat activated" or "subliming" dies which turn from a solid into a gas at a specified time, temperature and pressure. Dye sublimation is especially advantageous for printing images on fabrics. Indeed, when transferring an image onto fabric using a dye sublimation printing process, the dye is more than simply deposited on the surface fabric; it actually penetrates the depth of the fabric and dies its fibres. This results in stable and durable prints, which is desirable when printing images on clothes, since the clothes can be repeatedly machine-washed while causing minimal to no fading of the image printed thereon.

Traditionally, dye sublimation involves the two-step process of "transfer printing". Firstly, an image such as a photograph, text, or any other graphic design, is printed in reverse format onto an intermediary medium called a transfer substrate, using sublimation dye-containing inks; this transfer substrate can for example be a sheet of paper called a transfer sheet. During the transfer of the image to the transfer substrate, the dye is not sublimed; the dye is rather merely printed or deposited superficially onto the transfer substrate but is not permanently bound thereto.

The inked side of the transfer substrate is then positioned to face the permanent substrate (e.g. the front of a T-shirt), upon which the image is to permanently appear. A heating device, such as a heat press, is then used to apply elevated temperature and pressure to the transfer substrate, to cause the dye to sublime and diffuse into the depth of the permanent substrate where it permanently bonds.

The permanent substrate may be any type of material which will accept and retain the transferred image, including but not limited to fabric. For example, dye sublimation printing can be used to generate items such as T-shirts, coffee mugs, mouse pads, etc.

Initial dye-sublimation technology used ribbons to carry the sublimation dyes in solid form. More recent technology employed sublimation inks in liquid form. With either print set-up, it is necessary that the image be transferred onto an intermediary transfer substrate before being permanently transferred to the permanent substrate.

SUMMARY OF THE INVENTION

The present invention relates to a sublimation pen for use in a dye sublimation printing system, and for use with sublimation inks of the type comprising at least a liquid carrier and solid-form pigments insoluble in the liquid carrier, said sublimation pen comprising:

- a pen main body;
- an ink inlet provided on said pen main body;
- a variable-width ink passageway defined within said pen main body and capable of fluidly communicating with said ink inlet, said ink passageway defining:

- a sublimation chamber vestibule adjacent to said ink inlet and capable of fluidly communicating therewith;
- a sublimation chamber in fluid communication with said sublimation chamber vestibule, said sublimation chamber being wider than said sublimation chamber vestibule;
- a heating means for transmitting heat to said sublimation chamber; and
- a nozzle mounted to said pen main body, said nozzle defining a narrow discharge channel opening at a first end into said sublimation chamber outlet, and opening at a second end outwardly of said sublimation pen;

wherein sublimation ink injected in said pen body through said pen sublimation ink inlet may flow in said ink passageway, first through said sublimation chamber vestibule and then into said wider sublimation chamber within which the solid-state pigments of the sublimation ink are sublimed, the sublimed pigments being thereafter forcibly discharged out of the pen through said discharge channel of said nozzle.

In one embodiment, said pen main body comprises an inlet component defining said sublimation ink inlet, an insulating component secured to said inlet component and defining said sublimation chamber vestibule therein, and a sublimation component secured to said insulating component and defining said sublimation chamber.

In one embodiment, said sublimation pen is equipped with pressure regulating means for regulating ink flow between said pen sublimation ink inlet and said ink passageway.

In one embodiment, said ink inlet comprises an ink inlet chamber defining a downstream end opening into said sublimation chamber vestibule, and wherein said pressure regulating means comprise a coil spring nested in said sublimation chamber vestibule and biasing a ball towards said inlet chamber downstream end, and against a seat formed by said inlet chamber downstream end in fluid tight fashion.

In one embodiment, said sublimation chamber vestibule defines a cross-sectional area, and said sublimation chamber defines a cross-section area greater than said sublimation chamber vestibule cross-sectional area.

In one embodiment, said heating element operates at temperatures ranging between about 190° C. and 232° C.

The present invention relates to a dye sublimation printing system for printing images on a substrate with sublimation inks of the type comprising at least a liquid carrier and solid-form pigments insoluble in the liquid carrier, said dye sublimation printing system comprising:

- a printer body, having a printing tray for holding at least a portion of a substrate onto which an image is to be printed;
- power means providing power to said printing system;
- a printhead mounted to said printer body and comprising at least one sublimation pen comprising in turn:
  - a pen main body;
  - an ink inlet provided on said pen main body;
  - a variable-width ink passageway defined within said pen main body and capable of fluidly communicating with said ink inlet, said ink passageway defining:
    - a sublimation chamber vestibule adjacent to said ink inlet and capable of fluidly communicating therewith;

a sublimation chamber in fluid communication with said sublimation chamber vestibule, said sublimation chamber being wider than said sublimation chamber vestibule;

a heating device connected to said power means and capable transmitting heat to said sublimation chamber;

a nozzle mounted to said pen main body, said nozzle defining a narrow discharge channel opening at a first end into said sublimation chamber outlet, and opening at a second end outwardly of said sublimation pen; and ink feed means for selectively feeding sublimation ink to said sublimation pen;

wherein sublimation ink injected in said pen body through said pen sublimation ink inlet may flow in said ink passageway, first through said sublimation chamber vestibule and then into said wider sublimation chamber within which the solid-state pigments of the sublimation ink are sublimed, the sublimed pigments being thereafter forcibly discharged out of the pen through said discharge channel of said nozzle, and onto the substrate portion held in said printing tray.

In one embodiment, said ink feed means comprise at least one ink container for containing sublimation ink therein and connected through an ink outflow pipe to said sublimation pen, said ink container being connected to a pump for controlling the outflow of sublimation ink from said ink containers towards said sublimation pens.

In one embodiment, said printhead comprises at least three sublimation pens, and at least three ink containers, each one of said sublimation pens being connected to a corresponding one of said ink containers.

In one embodiment, said printhead in movably mounted to said printer body, and said printing system further comprises an actuator connected to said power means and operatively linked to said printhead in order to selectively actuate said printhead relative to said printer body.

The present invention relates to a method of use of a dye sublimation printing system, comprising the steps of:

a) providing a dye sublimation printing system comprising:

a printer body having a printing tray;

power means providing power to said printing system;

a printhead movably mounted to said printer body and comprising at least one sublimation pen comprising in turn:

a pen main body;

an ink inlet provided on said pen main body;

a variable-width ink passageway defined within said pen main body and capable of fluidly communicating with said ink inlet, said ink passageway defining:

a sublimation chamber vestibule adjacent to said ink inlet and capable of fluidly communicating therewith;

a sublimation chamber in fluid communication with said sublimation chamber vestibule, said sublimation chamber being wider than said sublimation chamber vestibule;

a heating means cooperating with said power means for transmitting heat to said sublimation chamber;

a nozzle mounted to said pen main body, said nozzle defining a narrowest discharge channel opening at a first end into said sublimation chamber outlet, and opening at a second end outwardly of said sublimation pen;

ink feed means for selectively feeding sublimation ink to said sublimation pen;

b) activating said heating means in order for them to transmit heat to said sublimation chamber;

c) positioning at least a portion of a substrate on said printing tray;

d) activating said ink feed means in order for sublimation ink to be fed to said sublimation pen;

e) circulating the sublimation ink into said sublimation pen through its said ink inlet;

f) circulating the sublimation ink into said sublimation chamber vestibule of said ink passageway;

g) circulating the sublimation ink into said wider sublimation chamber of said ink passageway, thus causing the pressure of the sublimation ink to drop;

h) subliming the solid-state pigments of the sublimation ink; and i) discharging the sublimed pigments out of said sublimation pen through said discharge channel of said nozzle, and onto the substrate portion held in said printing tray.

DETAILED DESCRIPTION OF THE EMBODIMENTS

Figure 1:
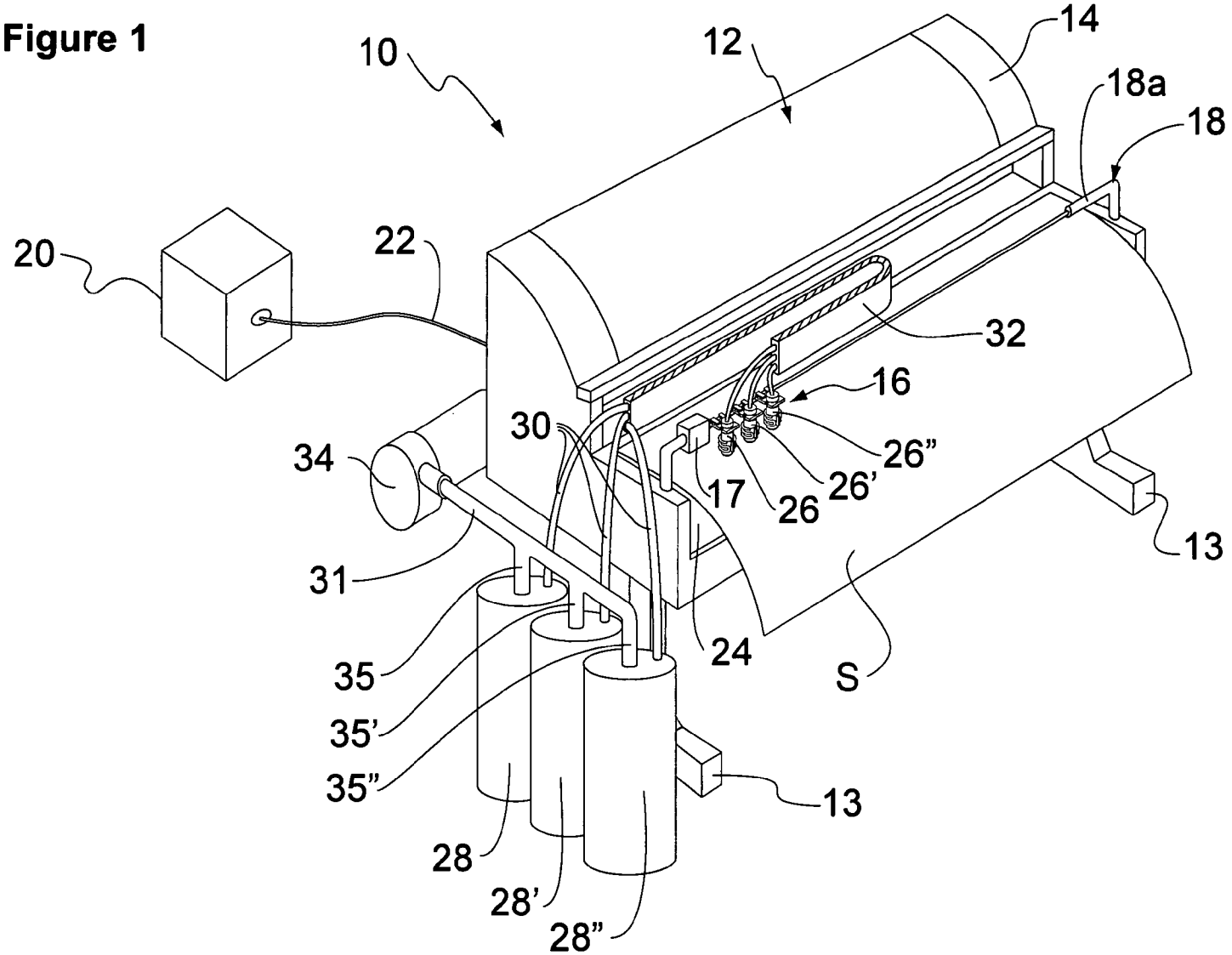
FIG. 1 shows a front perspective view of a dye sublimation printing system.

FIG. 1 shows a dye sublimation printing system 10 according to one embodiment of the present invention. A control device (not shown), such as a computer system, is connected to the printing system 10, and will send data signals thereto relating to the printing jobs to be accomplished by the printing system 10.

Printing system 10 comprises a printer body 12 mounted on a pair of legs 13, 13. Printer body 12 is of traditional construction, and is connected to a power source such as the schematically illustrated electrical power supply box 20 in FIG. 1, through the instrumentality of an electric cable 22. Printer body 12 comprises a housing 14 in which are nested a number of internal components which are expected to be found in traditional printers. For example, these components could include a number of internal rollers (not shown) which can be selectively rotated to progressively advance a sheet-shaped permanent substrate S from a sheet inlet (not shown, but which could be placed rearward of the printer housing 14), towards a printing tray 24 overhung by a printhead 16.

A U-shaped guiding rail 18 is attached to printer housing 14, such that a main elongated portion 18*a* thereof extends transversely across and is positioned spacedly above printing tray 24. Printhead 16 is slidably mounted on main elongated portion 18*a* of the guiding rail, and can be selectively slidably displaced therealong upon selective activation of an electrically powered actuating mechanism, symbolically represented in the drawings by a box-shaped actuator 17 integral to the printhead. Actuator 17 is connected to suitable control means (not shown), and can be controlled to selectively displace printhead 16 at any position between opposite ends of the guiding rail main portion 18*a*, when printing system 10 is accomplishing a printing job for example.

Printhead 16 comprises a number of sublimation pens (or cartridges); for example three sublimation pens 26, 26', 26" as illustrated in the drawings. Each sublimation pen 26 is connected to a distinct one of ink containers 28, 28', 28", through the instrumentality of a corresponding ink outflow pipe 30, 30', 30". Ink containers 28, 28', 28" can contain base colors which can be combined in various proportions to reproduce a whole spectrum of colours. For example, ink containers 28, 28', 28" could comprise cyan, magenta and yellow respectively (CMY), which are the three base colours of the subtractive color model.

In order to prevent ink outflow pipes 30, 30', 30" from hanging loosely and from interfering with the movement of printhead 16 along rail 18, the ink outflow pipes are encapsulated in a flexible organizer belt 32. Organizer belt 32 can also encapsulate a power supply cable (not shown) connected to printhead 16 and conveying electricity to electricity-powered components thereof. When printhead 16 moves axially along rail 18, flexible belt 32 can curl neatly to follow the movement of the printhead without interfering therewith.

Figure 2:
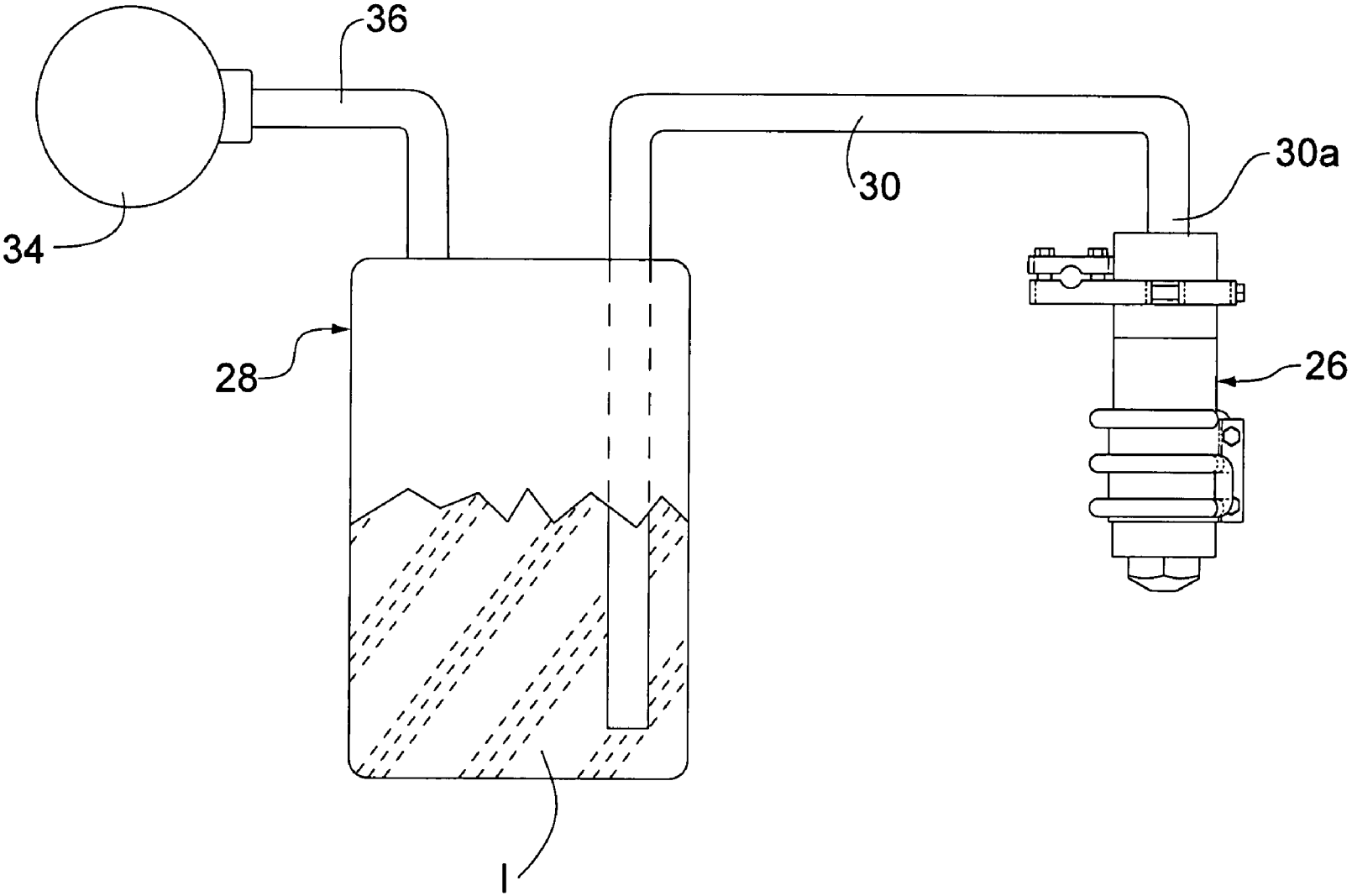
FIG. 2 shows a schematic front elevation view of a sublimation pen connected to an ink container, in turn connected to a pump, said ink container being partly broken for showing its inside content.

As shown in FIG. 1, and as schematically illustrated in FIG. 2, ink containers 28, 28', 28" are connected to a pump 34 through the instrumentality of pressure pipes 35, 35', 35" branching into a main pipe 31. Pump 34 is connected to a control means (not shown), which can activate the pump in order for it to selectively inject compressed air independently into each one of ink containers 28, 28', 28". The selective injection of compressed air into one of ink containers 28, 28', 28" will cause the outflow of sublimation ink I contained therein through ink outflow pipes 30, 30', 30" towards the sublimation pens 26, 26', 26" respectively.

Figure 3:
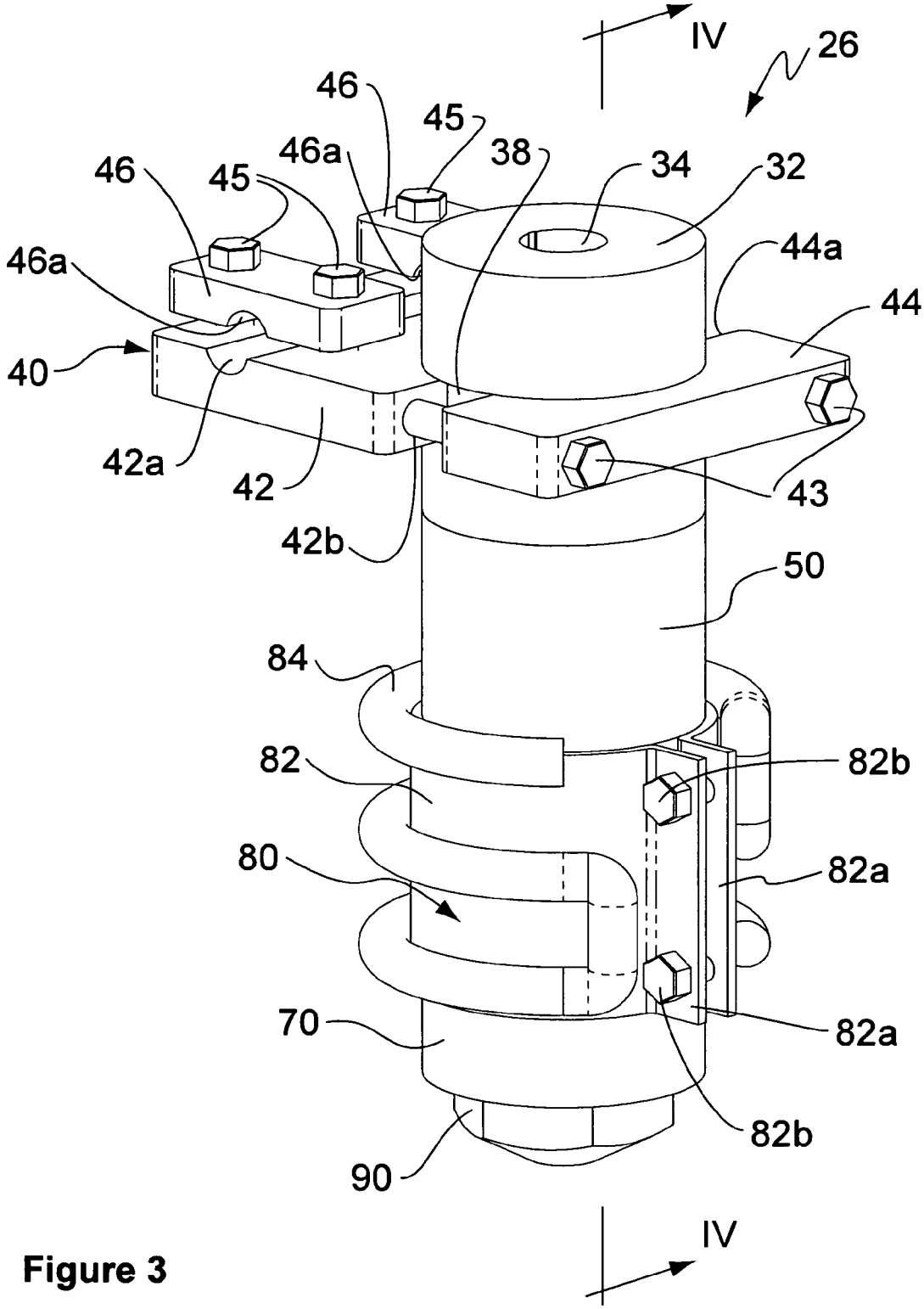
FIG. 3 shows a front perspective view of a sublimation pen.
Figure 4:
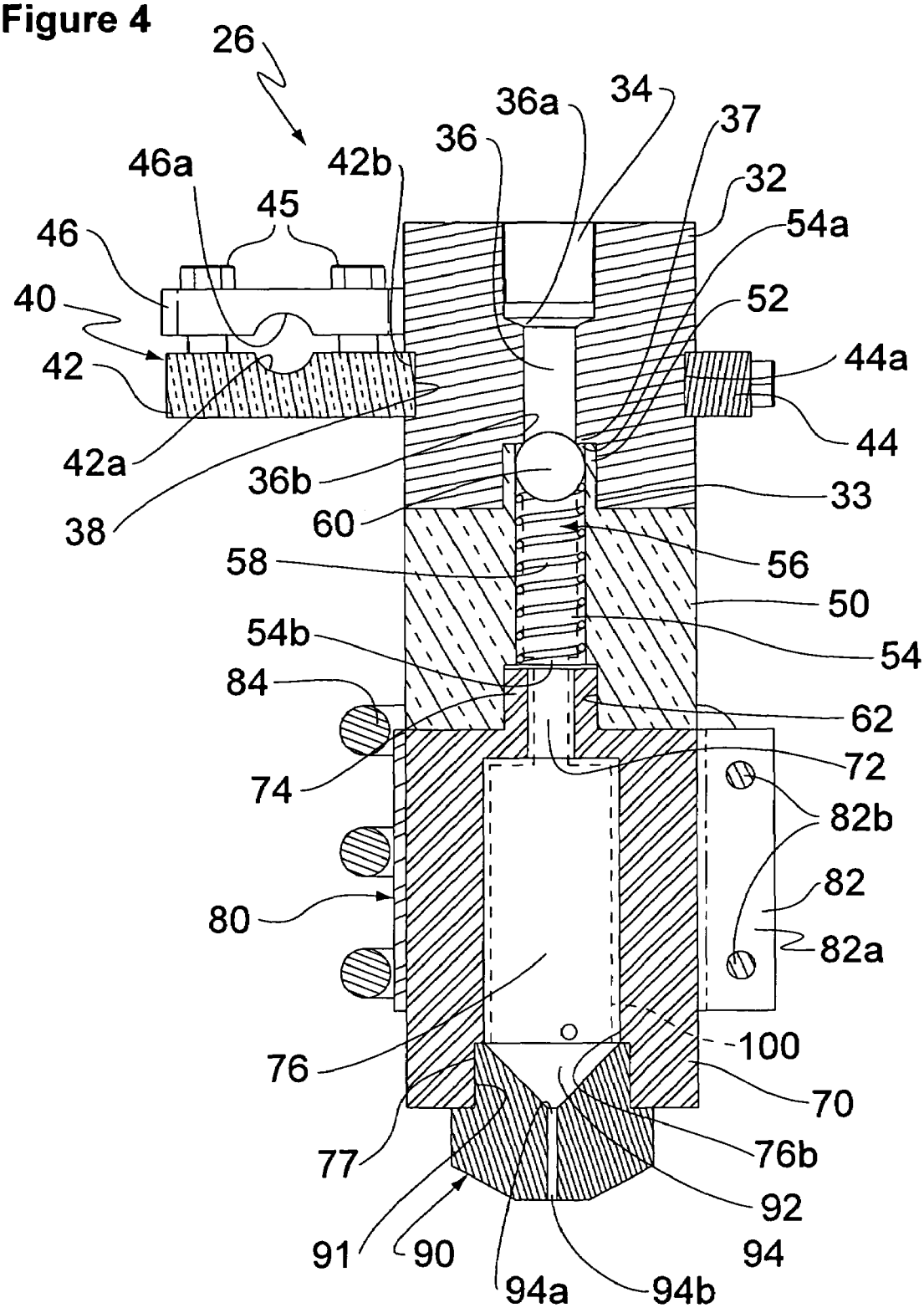
FIG. 4 shows a cross-sectional view taken along lines IV-IV of the sublimation pen of FIG. 3.

FIGS. 3-4 show enlarged views of one sublimation pen 26, and show that sublimation pen 26 defines a main body having a number of components. Firstly, sublimation pen 26 comprises an inlet component 32, made out of stainless steel for example, and having a hollow centre. This hollow centre defines a generally cylindrical inlet port 34 opening to the outside on one end, and connected at the other end to the upstream end 36*a* of a diametrically smaller cylindrical inlet chamber 36. Inlet port 34 is destined to be friction-fitted with a complementarily shaped end nipple 30*a* (FIG. 2) of one of ink outflow pipes 30. Moreover, inlet component 32, as can be seen in the cross-sectional view of FIG. 4, is provided with a widened portion in the form of a cylindrical socket 33 at the downstream end 36*b* of inlet chamber 36.

Inlet component 32 further comprises an annular recess 38 destined to receive a clamp assembly 40, which purpose is to slidably mount sublimation pen 26 to guiding rail 18 of the printer body 12, and to hold sublimation pen 26 in a vertical position such that the bottom end of pen 26 is located slightly spaced above the substrate S located in printing tray 24 onto which an image is to be printed. Clamp assembly 40 comprises a main clamp element 42, a pen clamp element 44, and rail clamp elements 46, 46.

Edges 42*b*, 44*a* of main and pen clamp elements 42, 44 respectively, both facing pen 26, have arcuate concave recesses made therein, allowing snug engagement thereof against the inner wall of the annular recess 38 of inlet part 32. A pair of bolts 43 is used to secure main and pen clamp elements 42 and 44 together and to tighten them around annular recess 38 of the sublimation pen 26, thus fastening the sublimation pen to the clamp assembly 40. Moreover, proximate to the edge of main clamp element 42 opposite its edge 42*b*, a hemicylindrical recess 42*a* is made on the top surface of main clamp element 42. Rail clamp elements 46, 46 are positioned above main clamp element 42, and each rail clamp element 46 is secured to main clamp element 42 by a pair of bolts 45, 45. Bolts 45 are thus orthogonal to bolts 43. Each rail clamp element 46 comprises a hemicylindrical recess 46*a* registering vertically above hemicylindrical recess 42*a*. When bolts 45 are tightened, the indentations 42*a* and 46*a*, 46*a* of main clamp element 42 and of rail clamp elements 45, 45 clasp the main elongated portion of guiding rail 18. Clamp assembly 40 is therefore slidably attached to guiding rail 18, and sublimation pen 26 is therefore slidable relative to guiding rail 18. Means, such as lubricant or friction-reducing coatings of polytetrafluoroethylene (Teflon®), could be employed on clamp assembly 40 and/or guiding rail 18 to ease the sliding movement of clamp assembly 40 and sublimation pen 26 along guiding rail 18.

Furthermore, the main body of sublimation pen 26 comprises a thermally insulating component 50, made out of a heatproof material such as porcelain. Insulating component 50 is axially aligned with inlet component 32, and a hollow cylindrical projection 52 of insulating component 50 is friction-fitted in socket 33 of inlet component 32, insulating component 50 and inlet component 32 being thereby secured together. Insulating component 50 comprises a centrical longitudinal cavity hereafter called the sublimation chamber vestibule 54, of cylindrical shape for example, extending upwardly through projection 52 and opening outwardly at its upstream end 54*a* coextensively into inlet chamber 36 of inlet component 32, and opening in the inlet cavity 72 of a sublimation component 70 at the opposite, downstream end 54*b*. Sublimation chamber vestibule 54 can for example have a diameter of 1 centimetre (0.38 inch), and forms the narrower segment of a variable-width ink passageway 100, schematically depicted in dotted lines in FIG. 4.

Sublimation chamber vestibule 54 is diametrically wider than inlet chamber 36, and may be fitted with optional pressure regulating means 56. In the embodiment of the drawings, the pressure regulating means 56 comprise a coil spring 58 acting upon a ball 60. Ball 60 has a slightly smaller diameter than that of sublimation chamber vestibule 54, and a radial play thus exists between ball 60 and the peripheral wall of sublimation chamber vestibule 54 enabling fluid flow therethrough. At rest, spring 58 biases ball 60 against the annular seat 37 formed at the intersection between socket 33 and the downstream end 36*b* of inlet chamber 36. In this rest position, ball 60 fully obstructs the open downstream end 36*b* of inlet chamber 36 in fluid tight fashion. However, if the pressure in inlet chamber 36 becomes important enough, as described herein after, ball 60 can be displaced spacedly away from seat 37 against the bias of spring 58 to clear downstream end 36*a*, so that fluid communication be established between inlet chamber 36 and sublimation chamber vestibule 54.

Underneath sublimation chamber vestibule 54 and in axial register therewith, insulating element 50 is provided with an attachment socket 62. Socket 62 is destined to be pressure-fitted with a hollow cylindrical projection 74 of a sublimation component 70 located underneath thermally insulating component 50. Sublimation component 70 is integral to the main body of pen 26, and defines an inlet cavity 72 at the level of projection 74, which opens into a diametrically larger sublimation chamber 76. The cross-sectional area and volume of sublimation chamber 76 are greater than those of sublimation chamber vestibule 54. Sublimation chamber 76 can for example have a diameter of 2.50 cm (1 in.), and forms the wider segment of variable-width ink passageway 100.

A heating device 80 is connected to sublimation component 70, made of a heat-conductive material such as stainless steel. Heating device 80 comprises a tightening collar 82 wrapped around the outer surface of sublimation component 70, and tightened around sublimation component 70 by bolts 82*b*, 82*b* screwed up between flanges 82*a*, 82*a*. Tightening collar 82 carries a tubular heating element 84 extending radially outwardly against collar 82, and which can be selectively electrically powered; electricity could for example be indirectly supplied thereto by power supply 20 connected to the printing system 10. Tightening collar 82 is made of a heat-conductive material capable of withstanding the temperature range at which the heating element 84 is destined to operate. Under heat exchange principles, heating element 84, when activated, transmits heat to the tightening collar 82, which diffuses the heat and transmits it to the sublimation component 70, and which in turn transmits it to sublimation chamber 76 and its content. Heating element 84 could for example be of the type operating at temperatures ranging between 190° C. (374° F.) and 232° C. (450° F.).

At the downstream end 76*b* of the sublimation chamber 76, sublimation component 70 defines a socket 77, into which is friction-fitted a complementary part 91 of a nozzle 90. Nozzle 90 comprises a funnel-shaped cavity 92 coextensive with the sublimation chamber 76 of the sublimation component 70, and the funnel-shaped cavity 92 converges towards the upstream end 94*a* of a diametrically smallest discharge channel 94, which in turn extends transversely within nozzle component 90 and opens at a downstream end 94*b* outwardly of sublimation pen 26. Discharge channel 94 can for example have a diameter of 0.15 cm (0.06 in.)

The dye sublimation printing system is destined to be used with "sublimation inks". Sublimation inks generally include, but are not limited to, inks comprising a liquid carrier, such as water or alcohol, and solid-state pigments which are insoluble in the liquid carrier. The pigments may have a width of for example 1 or 2 microns. Optionally, sublimation inks can also incorporate a binder substance such as resin to help the pigments bind to the substrate S when they are transferred thereto.

The operation of dye sublimation printing system 10 will now be described, when used with sublimation inks including only a liquid carrier and solid-state pigments.

If necessary, the printing system is loaded with a sheet-shaped substrate S, such as a rectangular sheet of fabric or paper. A print job is then sent to the printing system 10 by the computer system (not shown) connected thereto. The internal rollers (not shown) then advances the substrate sheet S towards the printing tray 24, and underneath the movable printhead 26 carrying the sublimation pens 26. In accordance with the image to be transferred to the substrate S, the rollers and printhead 26 will be correspondingly actuated, and pump 24 will respectively inject suitable amounts air into ink containers 28, 28', 28", in order for the right proportions of ink to be fed to sublimation pens 26, 26', 26" respectively, to obtain the desired final colors.

When pump 24 is activated and injects air into one of ink containers 28, sublimation ink is forced out of the container, and circulates in the corresponding ink outflow pipe 30. When the sublimation ink reaches the corresponding sublimation pen 26, it first enters into inlet chamber 36. When the pressure in inlet chamber 36 reaches a threshold value exceeding the mechanical compressive pressure applied by spring 58 on ball 60, spring 58 yields and ball 60 is pushed against the bias of the spring and clears downstream end 36*b* of inlet chamber 36. Fluid communication is thus established between inlet chamber 36 and sublimation chamber vestibule 54 of insulating member 50. Sublimation ink is thus allowed to enter ink passageway 100. The ink first enters within sublimation chamber vestibule 54 by flowing all around ball 60, which as mentioned above, is slightly smaller in diameter than the cylindrical sublimation chamber vestibule 54.

The sublimation ink thereafter follows its course down through the remaining segment of sublimation chamber vestibule 54, and enters the broader sublimation chamber 76 through inlet cavity of sublimation component 70, which has been suitably preheated to its operational temperature.

Thus, after having been injected in the sublimation pen 26, the sublimation ink circulates into the variable-width, two-tiered ink passageway 100. The passage of the sublimation ink from sublimation chamber vestibule 54 to the relatively diametrically wider sublimation chamber 76 causes the velocity and pressure of the sublimation ink to drop. Thus, when reaching the sublimation chamber 76, which has been brought to a high temperature by heating device 80, the sublimation ink finds itself subjected to high temperature and low pressure conditions which promote the sublimation of the solid pigments carried in the ink.

After having spent a certain time in the sublimation chamber, the sublimation ink is turned into vapour, i.e. the liquid carrier is vaporized and the solid-state pigments are sublimed. Under overpressure conditions generated by expansion of the vaporized sublimation ink within sublimation chamber 76 the ink vapour is funnelled by funnel-shaped cavity 92 inside the narrow discharge channel 94, through which it circulates before being forcibly discharged out of the sublimation pen onto the underlying substrate S.

All the while, the pressure regulator 56 regulates the inflow of ink into sublimation chamber 76. If the pressure in inlet chamber 36 is higher than the combined pressure of the sublimation chamber 76 and of spring 58 acting upon ball 60, ball 60 will clear the downstream end 36*a* of inlet chamber 36, to allow the injection of more sublimation ink into sublimation chamber. If not, ball 60 obstructs the downstream end 36*a* of inlet chamber 36 and blocks any fluid circulation between the two chambers. Thus, in addition to regulating the inflow of ink into the variable-width ink passageway 100, pressure regulator also acts as a one-way valve preventing backflow of fluid from passageway 100 into the inlet chamber 36.

If ink is being sublimed and discharged from multiple sublimation pens simultaneously, the outflowing jets of gaseous ink are combined before reaching and diffusing through the substrate.

It is of course understood that the liquid carrier of the ink is also turned into vapour, but volatilizes when reaching the substrate rather than binding thereto.

It will be readily noted that the above-described printing system exhibits the advantages of dye sublimation printing, while the fastidious intermediary task of first transferring the image to be printed onto an intermediary transfer substrate before applying it directly onto the permanent substrate is eliminated.

It is understood that modifications could be made to the above described invention, without departing from the scope of the present invention.

The printing system could be provided with alternate ink feed means for feeding sublimation ink to the sublimation pens, in replacement of the ink containers 28, the pump 24 and pipes 36 and 30. It could for example be provided with an ink inlet into which a disposable canister containing the sublimation ink could be fitted. This canister could discharge the sublimation ink at a desired rate into the variable-width passageway formed within the sublimation pen 26.

Moreover, any suitable pressure regulating means could be provided instead of spring-loaded pressure regulator 56. These pressure regulating means could be located at any location between the ink feed source (e.g. ink containers 28) and the variable-width ink passageway of the sublimation pen.

Furthermore, printing system 10 could be further provided with an ink preheating system to preheat the sublimation ink before it is fed to the sublimation pens.

Also, any suitable alternate heating means could be used to transmit heat to the sublimation chamber 76 instead of heating device 80.

It is also understood, that the shape and configuration of the different components of the sublimation pen could be freely modified without departing from the scope of the invention, as long as there remains a two-tiered, variable width ink passageway made within the body of the sublimation pen.

Other variants of the invention which would occur to a person ordinarily skilled in the art have been omitted from the present description for the sake of brevity, but are clearly included in the scope of the following claims.

The invention claimed is:

1. A sublimation pen for use in a dye sublimation printing system, and for use with sublimation inks of the type comprising at least a liquid carrier and solid-form pigments insoluble in the liquid carrier, said sublimation pen comprising:

a pen main body;

an ink inlet provided on said pen main body;

a variable-width ink passageway defined within said pen main body and capable of fluidly communicating with said ink inlet, said ink passageway defining:

a sublimation chamber vestibule adjacent to said ink inlet and capable of fluidly communicating therewith;

a sublimation chamber in fluid communication with said sublimation chamber vestibule, said sublimation chamber being wider than said sublimation chamber vestibule;

a heating means for transmitting heat to said sublimation chamber; and a nozzle mounted to said pen main body, said nozzle defining a narrow discharge channel opening at a first end into said sublimation chamber outlet, and opening at a second end outwardly of said sublimation pen;

wherein sublimation ink injected in said pen body through said pen sublimation ink inlet may flow in said ink passageway, first through said sublimation chamber vestibule and then into said wider sublimation chamber within which the solid-state pigments of the sublimation ink are sublimed, the sublimed pigments being thereafter forcibly discharged out of the pen through said discharge channel of said nozzle.

2. The sublimation pen according to claim 1, wherein said pen main body comprises an inlet component defining said sublimation ink inlet, an insulating component secured to said inlet component and defining said sublimation chamber vestibule therein, and a sublimation component secured to said insulating component and defining said sublimation chamber.

3. The sublimation pen according to claim 2, wherein said sublimation pen is equipped with pressure regulating means for regulating ink flow between said pen sublimation ink inlet and said ink passageway.

4. The sublimation pen according to claim 3, wherein said ink inlet comprises an ink inlet chamber defining a downstream end opening into said sublimation chamber vestibule, and wherein said pressure regulating means comprise a coil spring nested in said sublimation chamber vestibule and biasing a ball towards said inlet chamber downstream end, and against a seat formed by said inlet chamber downstream end in fluid tight fashion.

5. The sublimation pen according to claim 1, wherein said sublimation chamber vestibule defines a cross-sectional area, and said sublimation chamber defines a cross-section area greater than said sublimation chamber vestibule cross-sectional area.

6. The sublimation pen according to claim 2, wherein said heating element operates at temperatures ranging between about 190° C. and 232° C.

7. A dye sublimation printing system for printing images on a substrate with sublimation inks of the type comprising at least a liquid carrier and solid-form pigments insoluble in the liquid carrier, said dye sublimation printing system comprising:

a printer body, having a printing tray for holding at least a portion of a substrate onto which an image is to be printed;

power means providing power to said printing system;

a printhead mounted to said printer body and comprising at least one sublimation pen comprising in turn:

a pen main body;

an ink inlet provided on said pen main body;

a variable-width ink passageway defined within said pen main body and capable of fluidly communicating with said ink inlet, said ink passageway defining:

a sublimation chamber vestibule adjacent to said ink inlet and capable of fluidly communicating therewith;

a sublimation chamber in fluid communication with said sublimation chamber vestibule, said sublimation chamber being wider than said sublimation chamber vestibule;

a heating device connected to said power means and capable transmitting heat to said sublimation chamber;

a nozzle mounted to said pen main body, said nozzle defining a narrow discharge channel opening at a first end into said sublimation chamber outlet, and opening at a second end outwardly of said sublimation pen; and ink feed means for selectively feeding sublimation ink to said sublimation pen;

wherein sublimation ink injected in said pen body through said pen sublimation ink inlet may flow in said ink passageway, first through said sublimation chamber vestibule and then into said wider sublimation chamber within which the solid-state pigments of the sublimation ink are sublimed, the sublimed pigments being thereafter forcibly discharged out of the pen through said discharge channel of said nozzle, and onto the substrate portion held in said printing tray.

8. The dye sublimation printing system according to claim 7, wherein said ink feed means comprise at least one ink container for containing sublimation ink therein and connected through an ink outflow pipe to said sublimation pen, said ink container being connected to a pump for controlling the outflow of sublimation ink from said ink containers towards said sublimation pens.

9. The dye sublimation printing system according to claim 8, wherein said printhead comprises at least three sublimation pens, and at least three ink containers, each one of said sublimation pens being connected to a corresponding one of said ink containers.

10. The dye sublimation printing system according to claim 7, wherein said printhead in movably mounted to said printer body, and said printing system further comprises an actuator connected to said power means and operatively linked to said printhead in order to selectively actuate said printhead relative to said printer body.

11. A method of use of a dye sublimation printing system, comprising the steps of:

a) providing a dye sublimation printing system comprising:

a printer body having a printing tray;

power means providing power to said printing system;

a printhead movably mounted to said printer body and comprising at least one sublimation pen comprising in turn:

a pen main body;

an ink inlet provided on said pen main body;

a variable-width ink passageway defined within said pen main body and capable of fluidly communicating with said ink inlet, said ink passageway defining:

a sublimation chamber vestibule adjacent to said ink inlet and capable of fluidly communicating therewith;

a sublimation chamber in fluid communication with said sublimation chamber vestibule, said sublimation chamber being wider than said sublimation chamber vestibule;

a heating means cooperating with said power means for transmitting heat to said sublimation chamber;

a nozzle mounted to said pen main body, said nozzle defining a narrowest discharge channel opening at a first end into said sublimation chamber outlet, and opening at a second end outwardly of said sublimation pen;

ink feed means for selectively feeding sublimation ink to said sublimation pen;

b) activating said heating means in order for them to transmit heat to said sublimation chamber;

c) positioning at least a portion of a substrate on said printing tray;

d) activating said ink feed means in order for sublimation ink to be fed to said sublimation pen;

e) circulating the sublimation ink into said sublimation pen through its said ink inlet;

f) circulating the sublimation ink into said sublimation chamber vestibule of said ink passageway;

g) circulating the sublimation ink into said wider sublimation chamber of said ink passageway, thus causing the pressure of the sublimation ink to drop;

h) subliming the solid-state pigments of the sublimation ink; and i) discharging the sublimed pigments out of said sublimation pen through said discharge channel of said nozzle, and onto the substrate portion held in said printing tray.

* * * * *